US011824265B2

(12) United States Patent
Furuhi

(10) Patent No.: US 11,824,265 B2
(45) Date of Patent: Nov. 21, 2023

(54) ANTENNA MODULE AND COMMUNICATION DEVICE IN WHICH ANTENNA MODULE IS INCORPORATED

(71) Applicant: Murata Manufacturing Co., Ltd., Kyoto (JP)

(72) Inventor: Tomoshige Furuhi, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 392 days.

(21) Appl. No.: 17/319,725

(22) Filed: May 13, 2021

(65) Prior Publication Data

US 2021/0265743 A1 Aug. 26, 2021

Related U.S. Application Data

(63) Continuation of application No. PCT/JP2019/039424, filed on Oct. 7, 2019.

(30) Foreign Application Priority Data

Nov. 14, 2018 (JP) ..... 2018-213983

(51) Int. Cl.
*H01Q 21/06* (2006.01)
*H01Q 1/24* (2006.01)
(Continued)

(52) U.S. Cl.
CPC ..... *H01Q 21/061* (2013.01); *H01Q 1/246* (2013.01); *H01Q 21/065* (2013.01); *H01Q 21/22* (2013.01); *H01Q 21/24* (2013.01)

(58) Field of Classification Search
CPC ..... H01Q 21/061; H01Q 1/246; H01Q 21/22; H01Q 21/065; H01Q 21/24; H01Q 3/26;
(Continued)

(56) References Cited

U.S. PATENT DOCUMENTS 6,404,404 B1 * 6/2002 Chen ..... H01Q 23/00 381/92
7,797,816 B2 * 9/2010 Toso ..... H01P 11/00 29/601
(Continued)

FOREIGN PATENT DOCUMENTS

CN 108432046 A 8/2018
JP H08-204428 A 8/1996
(Continued)

OTHER PUBLICATIONS

International Search Report for International Patent Application No. PCT/JP2019/039424 dated Nov. 26, 2019.
(Continued)

*Primary Examiner* — Vibol Tan
(74) *Attorney, Agent, or Firm* — Pearne & Gordon LLP

(57) ABSTRACT

An antenna module is an array antenna in which an array of antenna elements extends in at least a first direction. The array of antenna elements in the first direction includes a first antenna group in a middle portion and a second antenna group in two end portions adjacent to the middle portion. The antenna elements in the first antenna group are unequally spaced. The spacing between adjacent antenna elements in the second antenna group is greater than the maximum spacing between adjacent elements in the first antenna group. The amplitude distribution in the antenna module as a whole in the first direction is in a unimodal form in which the amplitude of a radio-frequency signal fed to the antenna elements in the second antenna group is smaller than the amplitude of a radio-frequency signal fed to the antenna elements in the first antenna group.

20 Claims, 11 Drawing Sheets

(51) Int. Cl.
*H01Q 21/22* (2006.01)
*H01Q 21/24* (2006.01)

(58) Field of Classification Search
CPC ..... H01Q 3/30; H01Q 21/293; H01Q 25/00; H01Q 1/243; H01Q 3/24; H01Q 9/0485; H01Q 21/0018; H01Q 3/28
See application file for complete search history.

(56) References Cited

U.S. PATENT DOCUMENTS

| | | | | |
|---|---|---|---|---|
| 10,454,186 | B2 * | 10/2019 | Boyanov | H01Q 21/0087 |
| 10,516,209 | B2 * | 12/2019 | Noto | H01Q 21/06 |
| 10,886,630 | B2 * | 1/2021 | Onaka | H01Q 21/24 |
| 10,892,554 | B2 * | 1/2021 | Yamada | H01Q 21/065 |
| 11,011,843 | B2 * | 5/2021 | Onaka | H01Q 3/26 |
| 2018/0309195 | A1 | 10/2018 | Udagawa | |

FOREIGN PATENT DOCUMENTS

| | | | |
|---|---|---|---|
| JP | 2001-320232 | A | 11/2001 |
| WO | 2007/063298 | A1 | 6/2007 |
| WO | 2017/104761 | A1 | 6/2017 |

OTHER PUBLICATIONS

Written Opinion for International Patent Application No. PCT/JP2019/039424 dated Nov. 26, 2019.

* cited by examiner

| | ELEMENT SPACING | AMPLITUDE | TOTAL POWER [dB] | SIDE-LOBE LEVEL (SLL)[dBc] | |
|---|---|---|---|---|---|
| | | | | $\theta_0=0°$ | $\theta_0=45°$ |
| COMPARATIVE EXAMPLE 1 | EQUAL SPACING | EQUAL AMPLITUDE | 0 (REFERENCE) | −13.1 | −14.0 |
| COMPARATIVE EXAMPLE 2 | EQUAL SPACING | UNEQUAL AMPLITUDE | −2.1 | −20.5 | −20.5 |
| COMPARATIVE EXAMPLE 3 | UNEQUAL SPACING | EQUAL AMPLITUDE | 0 | −20.3 | −8.5 |
| EMBODIMENT | EQUAL SPACING AND UNEQUAL SPACING | UNEQUAL AMPLITUDE | −1.2 | −20.5 | −20.6 |

ANTENNA MODULE AND COMMUNICATION DEVICE IN WHICH ANTENNA MODULE IS INCORPORATED

CROSS REFERENCE TO RELATED APPLICATIONS

This is a continuation of International Application No. PCT/JP2019/039424 filed on Oct. 7, 2019 which claims priority from Japanese Patent Application No. 2018-213983 filed on Nov. 14, 2018. The contents of these applications are incorporated herein by reference in their entireties.

BACKGROUND OF THE DISCLOSURE

Field of the Disclosure

The present disclosure relates to an antenna module and a communication device in which the antenna module is incorporated and, more specifically, to a technique for improving the antenna characteristics of an array antenna.

Description of the Related Art

Approaches known as amplitude tapering and density tapering have been adopted to enable an array antenna including an array of antenna elements to achieve desired antenna characteristics. The amplitude tapering involves uneven distribution of excitation amplitude in antenna elements constituting the array antenna. The density tapering involves density distribution in the layout of antenna elements.

Such an amplitude-tapered array antenna is disclosed in Japanese Unexamined Patent Application Publication No. 8-204428 (Patent Document 1), which indicates that the spacing between columns of antenna elements in a region is greater than the spacing between columns of antenna elements in another region and that the excitation amplitude for the antenna elements adjacent to the region of increased spacing is greater than the excitation amplitude for the antenna elements in the region of increased spacing.

Patent Document 1: Japanese Unexamined Patent Application Publication No. 8-204428

BRIEF SUMMARY OF THE DISCLOSURE

The configuration disclosed in Patent Document 1 is aimed at minimizing degradation of antenna characteristics and enabling an array antenna to provide a mounting space for a fedome that protects the antenna against wind, rain, and the like. According to Patent Document 1, the mounting space for a fedome is provided in such a manner that the spacing between columns of antenna elements in a region is made greater than the spacing between columns of antenna element in another region, and the amplitude tapering is adopted such that the excitation amplitude distribution in the array antenna as a whole is in the form of Taylor distribution, which in turn suppresses side lobes to minimize degradation of antenna characteristics.

There is an upper limit of the power outputted from a common power amplifier that supplies antenna elements with radio-frequency power. This means that there will be a limit to the maximum power of radio waves outputted from the individual antenna elements. The power outputted from an antenna element is proportional to the square of the excitation amplitude applied to the antenna element. This is unfavorable for the configuration disclosed in Patent Document 1, which indicates that the excitation amplitude applied to the antenna elements adjacent to the region of increased spacing is greater than the excitation amplitude applied to the other antenna elements. Since the maximum power output in the relevant region is limited, the excitation amplitude applied to antenna elements in the other region may need to be reduced. Such a constraint would lead to a reduction in the total power of the antenna although the side-lobe reduction is achievable.

The present disclosure therefore has been made to solve the above-mentioned problem, and it is an object of the present disclosure to enable an array antenna to achieve side-lobe reduction in such a way as to inhibit the reduction in the total power output of the array antenna.

An antenna module disclosed herein is an array antenna in which an array of antenna elements is disposed in or on a dielectric substrate. The array of the antenna elements extends in at least a first direction along the dielectric substrate. The array of antenna elements in the first direction includes a first antenna group in a middle portion and a second antenna group in two end portions adjacent to the middle portion. The antenna elements in the first antenna group are unequally spaced, and the antenna elements in the second antenna group are equally spaced. The spacing between adjacent antenna elements in the second antenna group is greater than the maximum spacing between adjacent antenna elements in the first antenna group. The amplitude distribution in the antenna module as a whole in the first direction is in a unimodal form in which the amplitude of a radio-frequency signal fed to the antenna elements in the second antenna group is smaller than the amplitude of a radio-frequency signal fed to the antenna elements in the first antenna group.

According to the present disclosure, the excitation amplitude distribution in the array antenna as a whole is in a unimodal form. The spacing between adjacent antenna elements in the second antenna group in the end portions is greater than the spacing between adjacent antenna elements in the first antenna group in the middle portion. The (excitation) amplitude of the radio-frequency signal fed to the antenna elements in the second antenna group is smaller than the (excitation) amplitude of the radio-frequency signal fed to the antenna elements in the first group. That is, density tapering is applied to the antenna elements in the first antenna group, and excitation amplitude tapering is applied to the second antenna group. Thus, the excitation amplitude distribution in the array antenna as a whole is in a unimodal form. This configuration enables the array antenna to achieve side-lobe reduction in such a way as to inhibit the reduction in the total power output of the array antenna.

DETAILED DESCRIPTION OF THE DISCLOSURE

Figure 1:
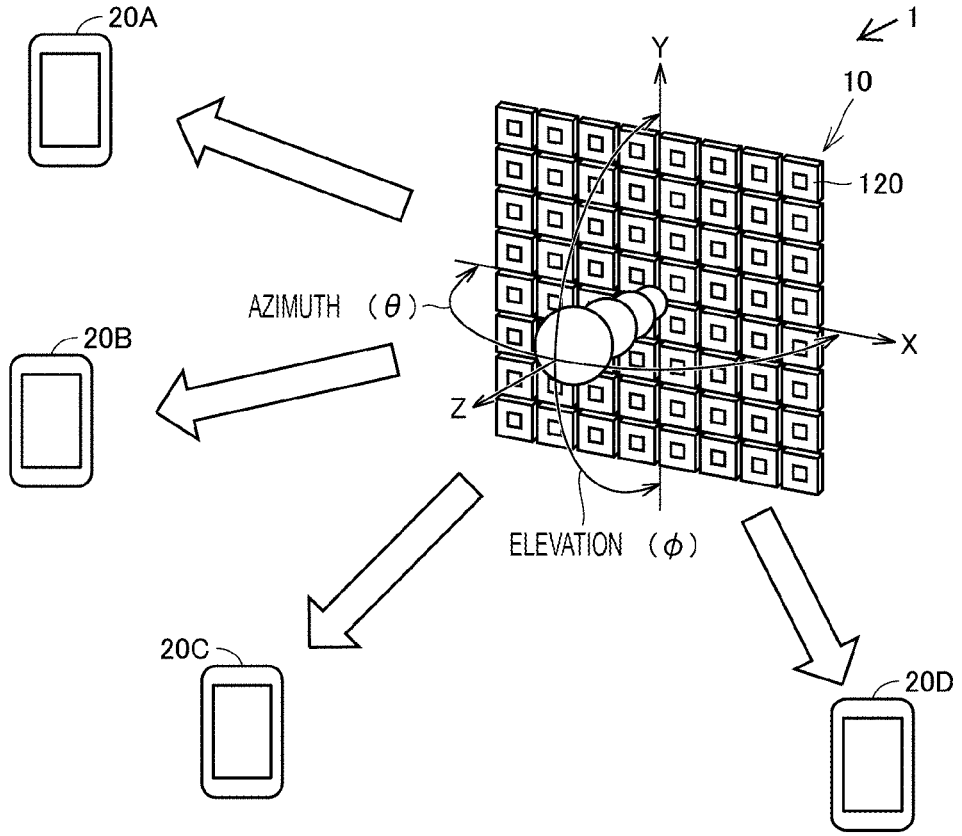
FIG. 1 illustrates an overview of a communication system in which an antenna module is used as a base station.

Embodiments of the present disclosure will be described below in detail with reference to the drawings. Note that the same or like parts in the drawings are denoted by the same reference signs throughout and redundant description thereof will be omitted.

(Overview of Communication System)

FIG. 1 illustrates an overview of a communication system 1, in which a communication device 10 including an antenna module according to an embodiment described herein is used as a base station. The communication system 1 includes a base station and mobile terminals 20. The communication device 10 is included in the base station. The mobile terminals 20 in an example, respectively, are denoted by 20A to 20D.

As a successor to the fourth-generation mobile communication system (4G) based on communication standards such as long term evolution (LTE) and LTE-Advanced, the fifth-generation mobile communication system (5G) is on the way. With the aim of implementing high-speed high-capacity communications in such a way as to ensure communication stability, the 5G system makes combined use of hitherto-used radio waves of lower frequencies (e.g., MHz bands or below) and radio waves of higher frequencies in millimeter-wave bands (e.g., several GHz to several dozen GHz).

The wavelengths of radio waves in high frequency ranges are so short that the radio waves can hardly reach distant target locations. Massive multiple-input and multiple-output (Massive MIMO) is an antenna technology proposed to address this problem. Massive MIMO is the technology of forming highly directional beams (beams that are sharply directional in a specific direction) by using an array of antenna elements to control radio waves from the individual antenna elements in such a way as to obtain a coherent overlap of in-phase waves. The highly directional beams of radio waves in high frequency bands may be transmitted over a somewhat long distance accordingly.

Massive MIMO enables wide-range beamforming in which the directivity of radio waves radiated from the antenna may be varied in the horizontal (azimuth) direction (i.e., along the X axis) and in the vertical (elevation) direction (i.e., along the Y axis). This means that radio waves from the antenna in the base station are individually radiated to the locations of the mobile terminals, and consistency in communication quality may be ensured accordingly.

The communication device 10 according to an embodiment described herein includes an antenna unit 120. The antenna unit 120 includes an array of antenna elements to enable beamforming which involves adjusting the phases of radio waves radiated from the individual antenna elements.

Radio waves radiated from an antenna forms a pattern that typically includes the main lobe and side lobes. The main lobe refers to radiation in the main direction, and the side lobes refer to radiation in lateral directions. Side lobe radiation, which is usually in an unintended direction, can be an interfering wave for a communication device situated in the direction concerned. A radio wave radiated in the direction of a side lobe and reflected by walls and buildings to reach a receiver can interfere with a radio wave radiated in the direction of the main lobe and received directly by the receiver, in which case reception becomes weak or unstable. In the event of a delay exceeding the symbol duration, intersymbol interference can occur, which is likely to lead to degradation of communication quality. It is thus preferable to reduce the side-lobe intensity in most cases.

A technique known for its potential for side-lobe reduction involves applying amplitude tapering so as to obtain uneven distribution of excitation amplitude of radio-frequency signals fed to antenna elements of an array antenna such that the excitation amplitude applied to the array antenna as a whole is in a unimodal form (e.g., in the form of Taylor distribution). However, there is a problem associated with the use of amplitude tapering; in some cases, such excitation amplitude distribution leads to reductions in the total potential power output of antennas.

To address the problem, an array antenna according to an embodiment described herein is designed to achieve side-lobe reduction in such a way as to inhibit the reduction in total power. Specifically, the array antenna includes an array of antenna element, with the excitation amplitude applied to the array antenna as a whole being in a unimodal form. The unimodal distribution is obtained by applying amplitude tapering to antenna elements in end portions of the array antenna and by providing density tapering, or more specifically, by reducing the spacing between adjacent antenna elements in the middle portion of the array antenna.

The following describes, in detail, the configuration of the communication device including an antenna module according to an embodiment.

(Basic Configuration of Communication Device)

Figure 2:
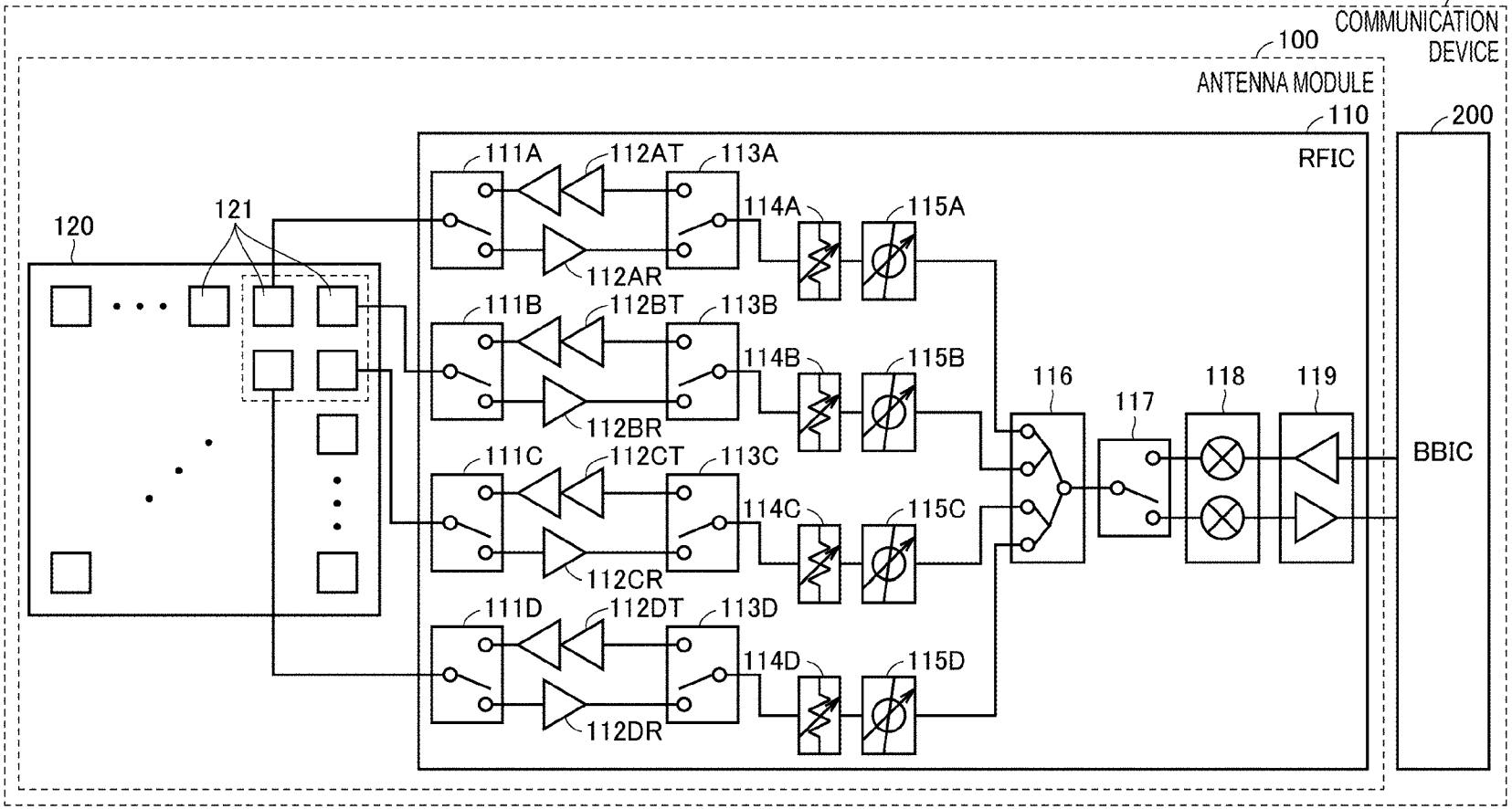
FIG. 2 is a block diagram of a communication device into which an antenna module according to an embodiment described herein is adopted.

FIG. 2 is a block diagram of the communication device 10, into which an antenna module 100 according to an embodiment described herein is adopted. The communication device 10 may, for example, be a mobile terminal (e.g., a mobile phone, a smart phone, or a tablet), a terminal device (e.g., a personal computer with communications capabilities), or a base station for establishing communication with the terminal device. The antenna module 100 according to an embodiment described herein may, for example, be used for radio waves in millimeter-wave bands with center frequencies of 28 GHz, 39 GHz, and 60 GHz and may also be used for radio waves in other frequency bands.

Referring to FIG. 2, the communication device 10 includes the antenna module 100 and a BBIC 200, which is a baseband signal processing circuit. The antenna module 100 includes an RFIC 110 and the antenna unit 120. The RFIC 110 is an example of a feeder circuit. The communication device 10 up-converts the signals transmitted from the BBIC 200 to the antenna module 100 and radiates the resultant radio-frequency signals through the antenna unit 120. The communication device 10 down-converts the radio-frequency signals received through the antenna unit 120, and the resultant signals are processed in the BBIC 200.

The antenna unit 120 is an array antenna including antenna elements (radiation electrodes) 121. The configurations corresponding to only four of the antenna elements 121 constituting the antenna unit 120 are illustrated in FIG. 2, from which the other antenna elements 121 with similar configurations are omitted for easy-to-understand illustration. The array antenna in FIG. 2 is configured as a two-dimensional array of antenna elements 121. Alternatively, the array antenna may be configured as a linear array of antenna elements 121. Each of the antenna elements 121 in an embodiment described herein is a patch antenna in the form of a flat plate that is substantially square in shape.

The RFIC 110 includes switches 111A to 111D, switches 113A to 113D, a switch 117, power amplifiers 112AT to 112DT, low-noise amplifiers 112AR to 112DR, attenuators 114A to 114D, phase shifters 115A to 115D, a signal combiner/splitter 116, a mixer 118, and an amplifier circuit 119.

Transmission of radio-frequency signals is accomplished by switching the switches 111A to 111D and the switches 113A to 113D to their respective positions for connections with the power amplifiers 112AT to 112DT and by connecting the switch 117 to a transmitting amplifier included in the amplifier circuit 119. Reception of radio-frequency signals is accomplished by switching the switches 111A to 111D and the switches 113A to 113D to their respective positions for connections with the low-noise amplifiers 112AR to 112DR and by connecting the switch 117 to a receiving amplifier included in the amplifier circuit 119.

The signals transmitted from the BBIC 200 are amplified in the amplifier circuit 119 and are then up-converted in the mixer 118. Transmission signals, namely, up-converted radio-frequency signals are each split into four waves by the signal combiner/splitter 116. The four waves flow through four respective transmission paths and are fed to different antenna elements 121. The phase shifters 115A to 115D disposed on the respective signal paths provide the individually adjusted degrees of phase shift, and the directivity of the antenna unit 120 is adjusted accordingly.

Reception signals, namely, radio-frequency signal received by the antenna elements 121 pass through four different signal paths and are combined by the signal combiner/splitter 116. The combined reception signals are down-converted in the mixer 118, are amplified in the amplifier circuit 119, and are then transmitted to the BBIC 200.

The RFIC 110 is configured as, for example, a one-chip integrated circuit component having the aforementioned circuit configuration. Alternatively, the RFIC 110 may include one-chip integrated circuit components, each of which is provided for the corresponding one of the antenna elements 121 and is constructed of switches, a power amplifier, a low-noise amplifier, an attenuator, and a phase shifter.

An antenna unit configured as a linear array will be discussed in Embodiment 1, and an antenna unit configured as a two-dimensional array will be discussed in Embodiment 2.

Embodiment 1

(Layout of Elements and Amplitude)

Figure 3:
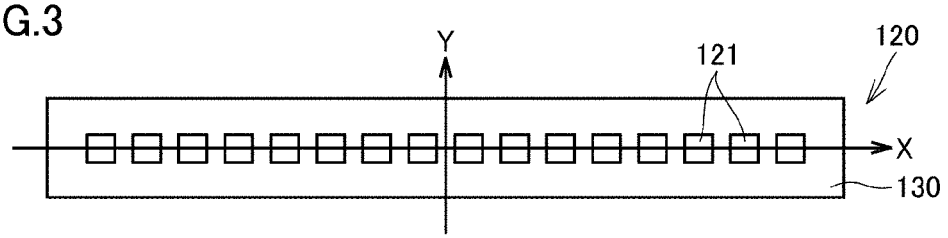
FIG. 3 illustrates an example of a linear-array antenna unit according to Embodiment 1.

FIG. 3 illustrates an example of the antenna unit 120 included in the antenna module according to Embodiment 1. The antenna unit 120 illustrated in FIG. 3 includes a dielectric substrate 130 and sixteen antenna elements 121. The antenna unit 120 is a linear array antenna including sixteen antenna elements 121 aligned in a row. With the center of the row of antenna elements (i.e., a point between the eighth antenna element from one end and the ninth antenna element from the end in FIG. 3) as the origin, the X axis represents the direction in which the antenna elements 121 are arranged, the Y axis is orthogonal to the X axis and represents the direction in which the dielectric substrate 130 extends, and the Z axis represents the direction normal to the antenna elements 121.

Figure 4:
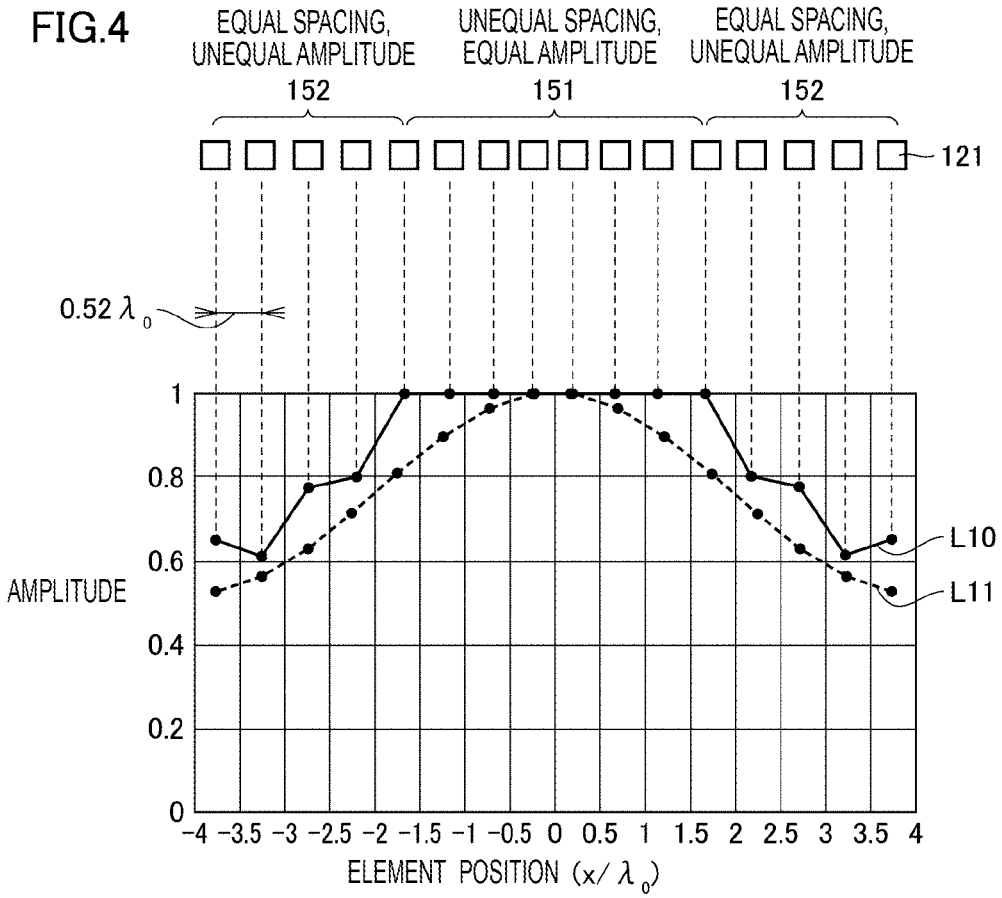
FIG. 4 is provided for explanation of the antenna element spacing and the excitation amplitude applied to the antenna unit illustrated in FIG. 3.

FIG. 4 is provided for explanation of the antenna element spacing and the excitation amplitude applied to the antenna elements in the antenna unit 120 illustrated in FIG. 3. The layout of the antenna elements 121 is schematically illustrated in the upper section of FIG. 4. The horizontal axis of the graph in the lower section of FIG. 4 represents the element position, and the vertical axis of the graph represents the excitation amplitude applied to each antenna element.

The element position represented by the horizontal axis is expressed as the ratio of x to $\lambda_0$ ($x/\lambda_0$), where $\lambda_0$ is the wavelength of a radio-frequency signal fed to the antenna element 121 in question and x is the distance from the origin to the antenna element 121 along the X axis. The excitation amplitude represented by the vertical axis is expressed as the ratio of the excitation amplitude applied to the antenna element 121 in question to the largest possible excitation amplitude for the antenna element 121.

L10, which is the solid line in the graph in FIG. 4, denotes the excitation amplitude applied to the antenna unit 120 in Embodiment 1. L11, which is the broken line in the graph, denotes the excitation amplitude applied to an amplitude-tapered antenna unit according to a comparative example in which antenna elements are equally spaced with excitation amplitude in the form of Taylor distribution.

The antenna elements 121 of the antenna unit 120 are divided into two groups, which are referred to as a first antenna group 151 and a second antenna group 152. The first antenna group is in the middle portion, and the second antenna group 152 is in two end portions adjacent to the first antenna group 151. Referring to FIG. 3, the fifth antenna element from one end of the array antenna and the fifth antenna element from the other end of the array antenna are the boundaries between the two groups. The antenna elements within the boundaries (i.e., the antenna elements closer to the center of the array antenna) are included in the first antenna group 151, and the antenna elements outside the boundaries (i.e., the antenna elements in the end portions of the array antenna) are included in the second antenna group 152.

The spacing between adjacent antenna elements in the first antenna group 151 is smaller than the spacing between adjacent antenna elements in the second antenna group 152. More specifically, the antenna elements in the first antenna group 151 are arranged in such a manner that the spacing between adjacent antenna elements closer to the center ($x/\lambda_0=0$) is greater than the spacing between adjacent antenna elements closer to the second antenna group 152 in the end portions. That is, the antenna elements in the first antenna group 151 are unequally spaced. The antenna elements in the second antenna group 152 are equally spaced, and the spacing between adjacent antenna elements in the second antenna group 152 is greater than the maximum spacing between adjacent antenna elements in the first antenna group 151.

All of the antenna elements in the first antenna group 151 are driven by the application of the largest possible excitation amplitude. The antenna elements in the second antenna group 152 are driven by the application of their respective excitation amplitudes. In other words, radio-frequency signals of the same amplitude are fed to the antenna elements in the first antenna group 151, and radio-frequency signals of unequal amplitude are fed to the antenna elements in the second antenna group 152. The excitation amplitude applied to the antenna elements in the second antenna group 152 is determined in such a way as to ensure that the excitation amplitude distribution in the array antenna as a whole is unimodal, or more specifically, in the form of Taylor distribution. This will be described later.

Figure 5:
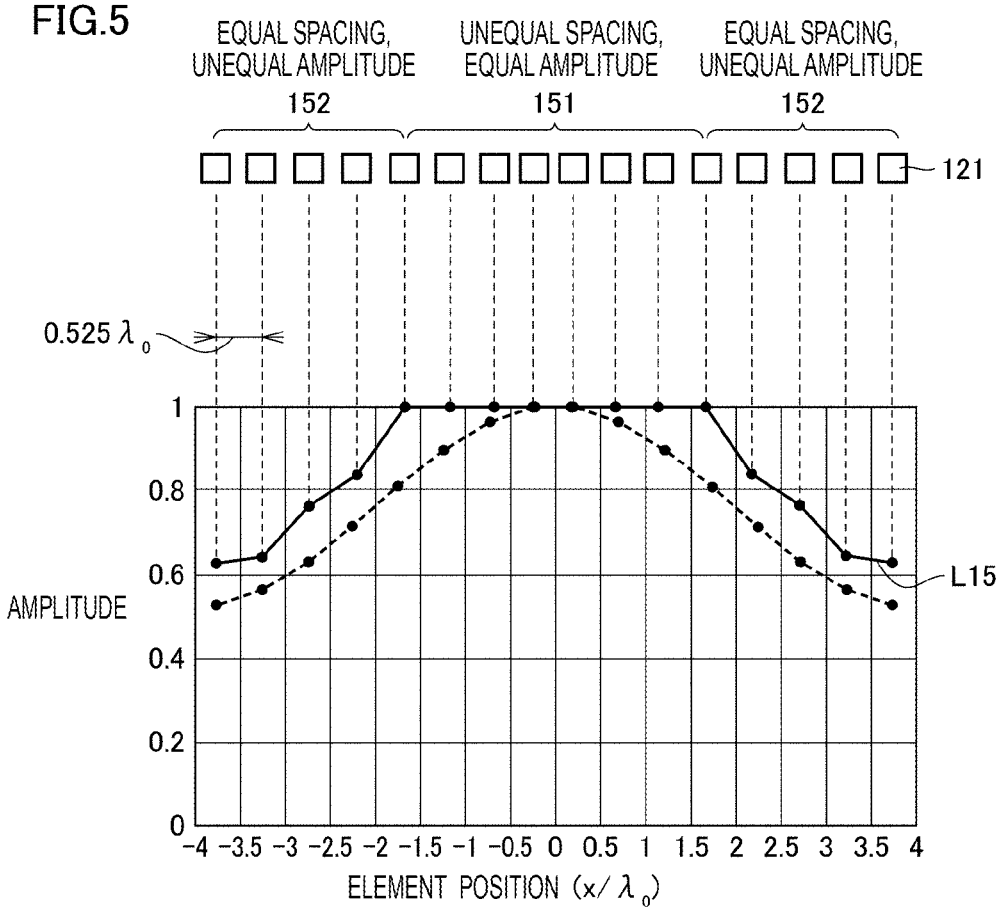
FIG. 5 illustrates the antenna element spacing and the excitation amplitude applied to the antenna elements in another example.

Referring to FIG. 4, the spacing between the antenna elements in the second antenna group 152 is $0.52\lambda_0$. The excitation amplitude applied to the second antenna group 152 in this example is varied in such a manner that the excitation amplitude applied to the first antenna element from an end of the array antenna is greater than the excitation amplitude applied to the second antenna element from the end. Referring to FIG. 5, the spacing between the antenna elements in the second antenna group 152 is $0.525\lambda_0$. As denoted by L15, which is a line in FIG. 5, the excitation amplitude in the second antenna group 152 in this example is varied in such a manner that the excitation amplitude applied to an antenna element closer to either of two ends of the array antenna is smaller than the excitation amplitude applied to an antenna element farther from the end.

An approach for determining the spacing between adjacent elements in Embodiment 1 is presented below with reference to FIGS. 6 to 9A and 9B.

As an introduction to the discussion, Taylor distribution will be described. Taylor distribution is generally regarded as the excitation distribution for the case in which the desired directivity is equivalent to a combination of the directivity in the form of Chebyshev distribution and the directivity in the form of uniform distribution with the m-th node being a connection point. Taylor distribution $p(\xi)$ is determined by Equation (1)

$$p(\xi) = 1 + 2\sum_{k=1}^{m-1} F_k(\beta, \sigma)\cos(\pi k\xi) \tag{1}$$

$$F_k(\beta, \sigma) = (-1)^{k+1}\frac{\prod_{n=1}^{m-1}\left[1 - \frac{k^2}{\sigma^2\left[\beta^2 + \left(n - \frac{1}{2}\right)^2\right]}\right]}{2\prod_{\substack{n=1\\n\neq k}}^{m-1}\left(1 - \frac{k^2}{n^2}\right)} \tag{2}$$

-continued $$\beta = \frac{\cosh^{-1} R}{\pi} \tag{3}$$

$$\sigma = \sqrt{\frac{m^2}{\beta^2 + \left(m - \frac{1}{2}\right)^2}}. \tag{4}$$

R represents the inverse of the side-lobe level given as the true value of amplitude. Let $SLL_{dB}$ represent the side-lobe level expressed in decibels. Then R is given by Equation (5).

$$R = 10^{-\frac{SLL_{dB}}{20}} \tag{5}$$

In the case that the ratio of the side-lobe level to the main lobe is −20 dBc, R=10.

Figure 6:
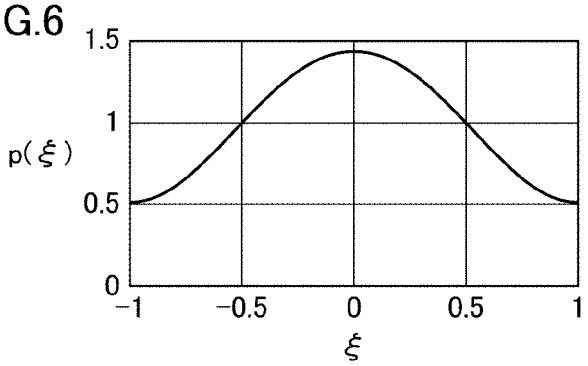
FIG. 6 illustrates an example of Taylor distribution.

FIG. 6 illustrates an example of Taylor distribution given by Expression (1) for the case in which the side-lobe level is −25 dBc and m=3.

Given the specified values of the element spacing in the end portions of the array antenna, the following describes a procedure of how to determine the layout of antenna elements for the combination of equal amplitude and unequal amplitude.

Figure 7:
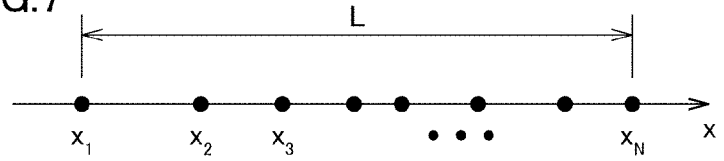
FIG. 7 is a first diagram for explanation of the layout of antenna elements.

As illustrated in FIG. 7, the individual antenna elements are assigned to the coordinate ($x_1, x_2, \ldots, x_N$) in the order from the negative side in the X-axis direction, in which case N denotes the number of antenna elements. Let L represent the distance between the first antenna element and the last antenna element in the array. Then L, which is a parameter associated with the size of the antenna, is given by Equation (6).

$$L = x_N - x_1 \tag{6}$$

The cumulative function $A(\xi)$ for the given excitation distribution $p(\xi)$ for the case $-1 \leq \xi \leq 1$ is expressed by Equation (7).

$$A(\xi) = \int_{-1}^{\xi} p(\xi')d\xi' \tag{7}$$

As expressed by the following equation, $\xi$ is directly proportional to x with proportionality constant $\gamma$.

$$\xi_i = \gamma x_i \tag{8}$$

Figure 8:
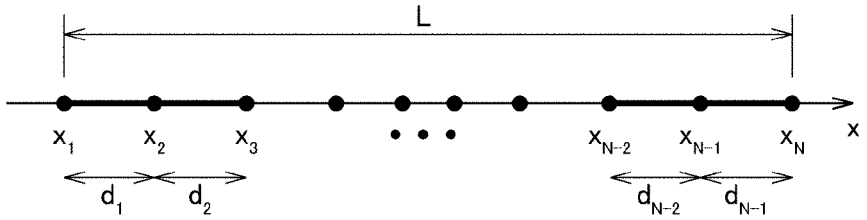
FIG. 8 is a second diagram for explanation of the layout of antenna elements.

In the linear array of antenna elements illustrated in FIG. 7, the specified values of the spacing between adjacent ones of the first ($x_1$) to q-th elements from the end on the negative side and the specified values of the spacing between adjacent ones of the first ($x_N$) to r-th elements from the end on the positive side are given by Equation (9). This layout of antenna elements is illustrated in FIG. 8.

(q Elements on Negative Side) (r Elements on Positive Side)

$$\begin{array}{ll} x_2 - x_1 = d_1 & x_N - x_{N-1} = d_{N-1} \\ x_3 - x_2 = d_2 & x_{N-1} - x_{N-2} = d_{N-2} \\ \vdots & \vdots \\ x_{q+1} - x_q = d_q & x_{N-r+1} - x_{N-r} = d_{N-r} \end{array} \tag{9}$$

Figures 9A, 9B:
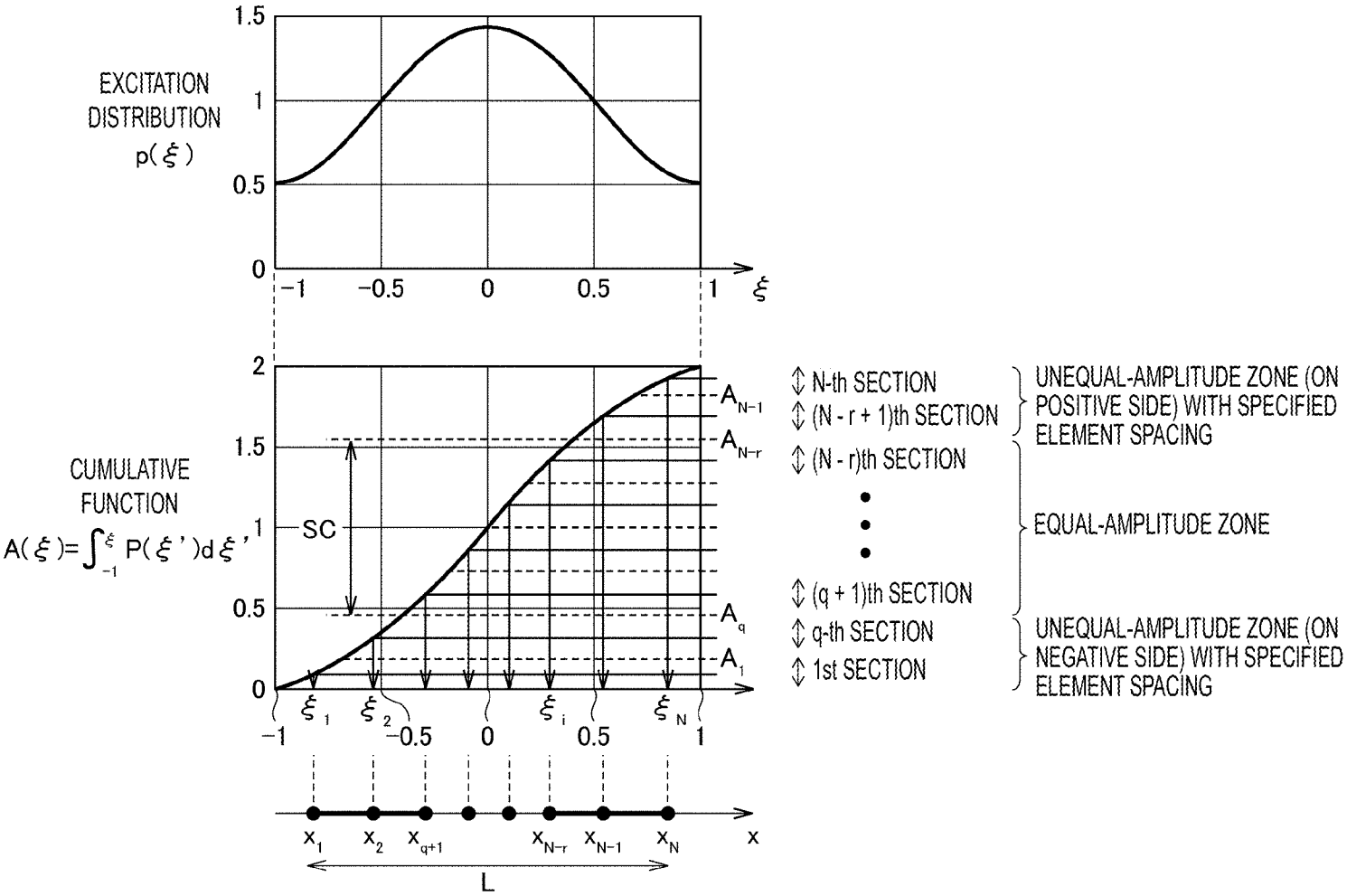
FIGS. 9A and 9B are provided for explanation of a procedure by which the layout of antenna elements is determined.

The cumulative function will be analyzed below with reference to FIGS. 9A and 9B, in which segmentation is made according to the amplitude applied to the individual antenna elements. The excitation distribution p(ξ) in the form of Taylor distribution in FIG. 6 is presented in FIG. 9A, and the cumulative function A(ξ) is presented in FIG. 9B. The cumulative function for the zone with the specified element spacing, that is, the cumulative function for q sections on the negative side and the cumulative function for r sections on the positive side can be expressed by Equation (10).

(q Elements on Negative Side) (r Elements on Positive Side)

$$A(\xi_1) = \frac{0 + A_1}{2} \qquad A(\xi_N) = \frac{A_{N-1} + 2}{2} \tag{10}$$

$$A(\xi_2) = \frac{A_1 + A_2}{2} \qquad A(\xi_{N1}) = \frac{A_{N-2} + A_{N-1}}{2}$$

$$\vdots \qquad \vdots$$

$$A(\xi_q) = \frac{A_{q-1} + A_q}{2} \qquad A(\xi_{N-r+1}) = \frac{A_{N-r} + A_{N-r+1}}{2}$$

The left end of the cumulative function curve in the (q+1)th section is denoted by $A_q$, and the right end of the cumulative function curve in the (N−r)th section is denoted by $A_{N-r}$. The zone between $A_q$ and $A_{N-r}$ is expressed as [$A_q$, $A_{N-r}$] (denoted by SC in FIG. 9B). The spacing between antenna elements in [$A_q$, $A_{N-r}$] are not specified by Equation (9), and the antenna elements in this zone may thus be arranged in such a manner that the difference between the amplitude at $A_{N-r}$ and the amplitude at $A_q$ is divided into (N−q−r) equal portions. The i-th section (q+1≤i≤N−r) can thus be written as Expression (11).

$$\left[\frac{(N-r-i+1)A_q + (i-1-q)A_{N-r}}{N-q-r}, \frac{(N-r-i)A_q + (i-q)A_{N-r}}{N-q-r}\right] \tag{11}$$

Equation (12) may be derived, in relation to the layout of antenna elements, by using the median of a range of values obtained from the expression.

$$A(\xi_i) = \frac{\left(N-r-i+\frac{1}{2}\right)A_q + \left(i-\frac{1}{2}-q\right)A_{N-r}}{N-q-r} \quad (q+1 \le i \le N-r) \tag{12}$$

With N unknowns for $x_i$, N unknowns for $\xi_i$, (q+r) unknowns for $A_i$, and one unknown for γ being involved, the total number of unknowns involved is (2N+q+r+1). Equation (6) is an independent equation, Equation (8) includes N independent equations, Equation (9) includes (q+r) independent equations, Equation (10) includes (q+r) independent equations, and Equation (12) includes (N−q−r) independent equations. That is, the total number of equations independent of one another is (2N+q+r+1), which is equal to the total number of unknowns involved. Then, these equations are uniquely solvable. In the case that the excitation amplitude ($w_i$) given by Equation (13) is applied to the individual antenna elements arranged with spacing determined by solving these equations, the excitation amplitude applied to the array antenna as a whole is in the form of Taylor distribution.

$$w_i = \begin{cases} \frac{N-r-q}{A_{N-r} - A_q}(A_i - A_{i-1}) & i \le q \text{ or } i \ge N-r+1 \\ 1 & q+1 \le i \le N-r \end{cases} \tag{13}$$

Equation (14) is derived from Expression (9).

$$x_i = x_1 + \sum_{k=1}^{i-1} d_k \qquad 2 \le i \le q+1 \tag{14}$$

$$x_i = x_N - \sum_{k=i}^{N-1} d_k \quad N-r \le i \le N-1$$

Rearranging Equation (15) in which Δx is a variable yields Equation (6).

$$x_1 = -\frac{L}{2} + \Delta x \tag{15}$$

$$x_N = \frac{L}{2} + \Delta x$$

Equations (16) and (17) are derived from Equation (10).

$$A_q = 2\sum_{p=1}^{q}(-1)^{q-p}A(\xi_p) \tag{16}$$

$$A_{N-r} = 2\sum_{p=1}^{r}(-1)^{r-p}A(\xi_{N-p+1}) + 2(-1)^{-r} \tag{17}$$

Rearranging Equations (16) and (17) applied to Equation (12) for the case in which i=q+1 and i=N−r yields Equations (18) and (19).

$$2(N-q-r-1)\sum_{p=1}^{q}(-1)^{q-p}A(\xi_p) - \left(N-q-r-\frac{1}{2}\right)A(\xi_{q+1}) + \frac{1}{2}A(\xi_{N-r}) = 0 \tag{18}$$

$$2(N-q-r-1)\left[\sum_{p=1}^{r}(-1)^{r-p}A(\xi_{N-p+1}) + (-1)^{-r}\right] + \frac{1}{2}A(\xi_{q+1}) - \left(N-q-r-\frac{1}{2}\right)A(\xi_{N-r}) = 0 \tag{19}$$

Substituting Equations (6), (14) and (15) into ξi in Equations (18) and (19) yields simultaneous equations in implicit form in which γ and Δx are unknowns. Then, the bivariate Newton's method may be applied, in which case the simultaneous equations derived from Equations (18) and (19) can be solved by performing mathematical calculation for several iterations.

Figure 10:
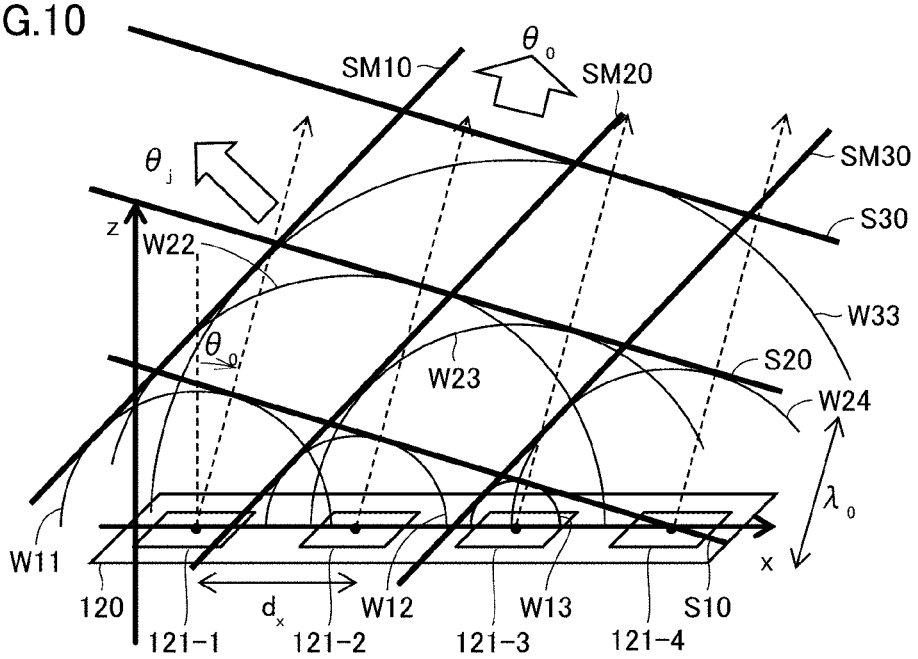
FIG. 10 is provided for explanation of the principle of how grating lobes occur.
Figure 11:
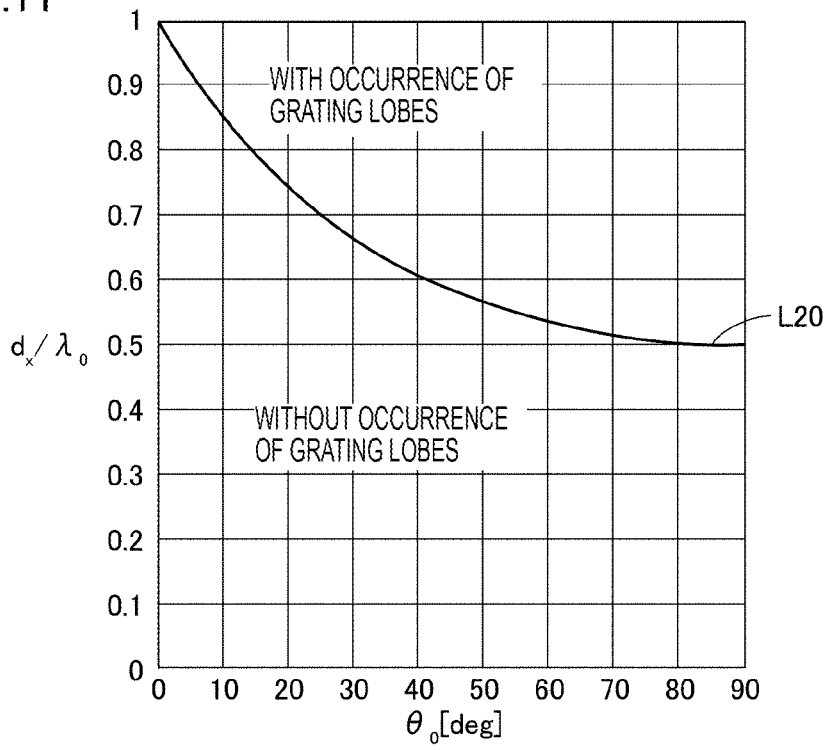
FIG. 11 is provided for explanation of the relationship between the element spacing and the occurrence of grating lobes.

The following describes the relationship between the antenna element spacing and grating lobes with reference to FIGS. 10 and 11. When an array antenna in which the antenna element spacing is equal to or more than half the wavelength is steered to radiate beams at an azimuth angle $\theta_0$ through phase synthesis, it is possible that the array antenna will produce lobes in directions (e.g., at an azimuth angle $\theta_j$) other than the desired direction. Such an unintended lobe, which is a king of side lobes, is known as a grating lobe.

FIG. 10 is provided for explanation of the principle of how grating lobes occur. Beamforming will be described below with reference to FIG. 10, in which a linear array of antenna elements is included in the antenna unit 120 as in the case illustrated in FIG. 3. With $d_x$ as the spacing between adjacent antenna elements, the main beam from the antenna unit 120 is steered in the direction of the azimuth angle $\theta_0$, which is the angle of tilt from the Z-axis direction to the positive side in the X-axis direction.

The main beam steered in the direction of the azimuth angle $\theta_0$ is obtained through radiation of radio waves with phase delay sequentially added in the order from an antenna element 121-1, which is close to the origin in FIG. 10, to the positive side in the X-axis direction. W11 is the wavefront in a radio wave radiated from the antenna element 121-1. Wavefronts in phase with the wavefront W11 are, for example, a wavefront W12 in a radio wave radiated from an antenna element 121-2 and a wavefront W13 in a radio wave radiated from an antenna element 121-3. These in-phase wavefronts are in tangent to an equiphase surface S10. Radio waves propagate in the direction of the normal to the equiphase surface S10. Similarly, an equiphase surface S20, which is one wavelength ($\lambda_0$) ahead of the equiphase surface S10, is given by, for example, a wavefront W22 in a radio wave radiated from the antenna element 121-2, a wavefront W23 in a radio wave radiated from the antenna element 121-3, and a wavefront W24 in a radio wave radiated from the antenna element 121-4. An equiphase surface S30, which is one wavelength ($\lambda_0$) ahead of the equiphase surface S20, is given by, for example, a wavefront W33 of a radio wave radiated from the antenna element 121-3.

Although the wavefront W11 in the radio wave radiated from the antenna element 121-1, the wavefront W22 in the radio wave radiated from the antenna element 121-2, and the wavefront W33 in the radio wave radiated from the antenna element 121-3 are out of phase with a phase difference of $2n\pi$, these wavefronts are in phase with each other on an equiphase surface SM10. Similarly, SM20 and SM30 denote equiphase surfaces on which such wavefronts with a phase difference of $2n\pi$ are in phase with each other. In the presence of the equiphase surfaces SM10, SM20, and SM30, radio waves propagate in the direction of the azimuth angle $\theta_j$. These radio waves are grating lobes.

The phase difference between excitation amplitudes applied to adjacent antenna elements is denoted by $\Delta\phi$, which can be expressed by Equation (20).

$$\Delta\phi = 2\pi\frac{d_x \sin\theta_0}{\lambda_0} = 2\pi\frac{d_x \sin\theta_j}{\lambda_0} + 2\pi j \tag{20}$$

Making $\theta_j$ the subject of the equation above gives Equation (21).

$$\theta_j = \arcsin\left(\sin\theta_0 - j\frac{\lambda_0}{d_x}\right) \tag{21}$$

The condition for the occurrence of a grating lobe $\theta_1$ obtained as the lowest-order (j=1) solution is expressed by Inequality (22), which can be rewritten as Inequality (23).

$$\left|\sin\theta_0 - \frac{\lambda_0}{d_x}\right| \le 1 \tag{22}$$

$$\frac{d_x}{\lambda_0} \ge \frac{1}{1+\sin\theta_0} \tag{23}$$

FIG. 11 is a graphical representation of the relationship expressed by Inequality (23). The horizontal axis of the graph in FIG. 11 represents the azimuth angle $\theta_0$, which corresponds to the direction in which the main beam is steered. The vertical axis of the graph represents the element spacing. Let the element spacing denote the ratio of the actual element spacing $d_x$ to the wavelength $\lambda_0$ of radio waves radiated from the antenna. According to Inequality (23), grating lobes occur in each direction of the azimuth angle $\theta_0$ in the case that the corresponding element spacing plot is in the region above L20, which is the solid line in FIG. 11. It can be seen from FIG. 11 that as the element spacing increases, the occurrence of grating lobes increases.

For the case in which the azimuth angle $\theta_0=60°$, grating lobes occur at the points where the inequality $d_x/\lambda_0>0.536$ holds. Thus, eliminating or reducing the occurrence of grating lobes for the case in which the azimuth angle $\theta_0=60°$ requires that the element spacing $d_x$ be smaller than $0.536\lambda_0$.

(Results of Simulations)

With consideration given to the relationship mentioned above, the side-lobe level and the total power were determined by simulation conducted under the following conditions: an array of 16 antenna elements (N=16); the first antenna element and the last antenna element in the array at $7.5\lambda_0$ apart from each other ($L=7.5\lambda_0$); excitation amplitude distribution in the form of Taylor distribution for the side-lobe level of −20 dBc and m=2; antenna elements disposed at $0.52\lambda_0$ apart from each other in four sections of the second antenna group 152 in each end portion of the array antenna.

For comparison, simulations were conducted on an array of equally spaced antenna elements with the fixed (maximum) excitation amplitude (Comparative Example 1), an amplitude-tapered array of equally spaced antenna elements with (unequal) excitation amplitude in the form of Taylor distribution (Comparative Example 2), and a density-tapered array with gradual decrease in the element spacing in the direction from each end to the middle portion of the array and with fixed (maximum) excitation amplitude (Comparative Example 3).

Figure 12:
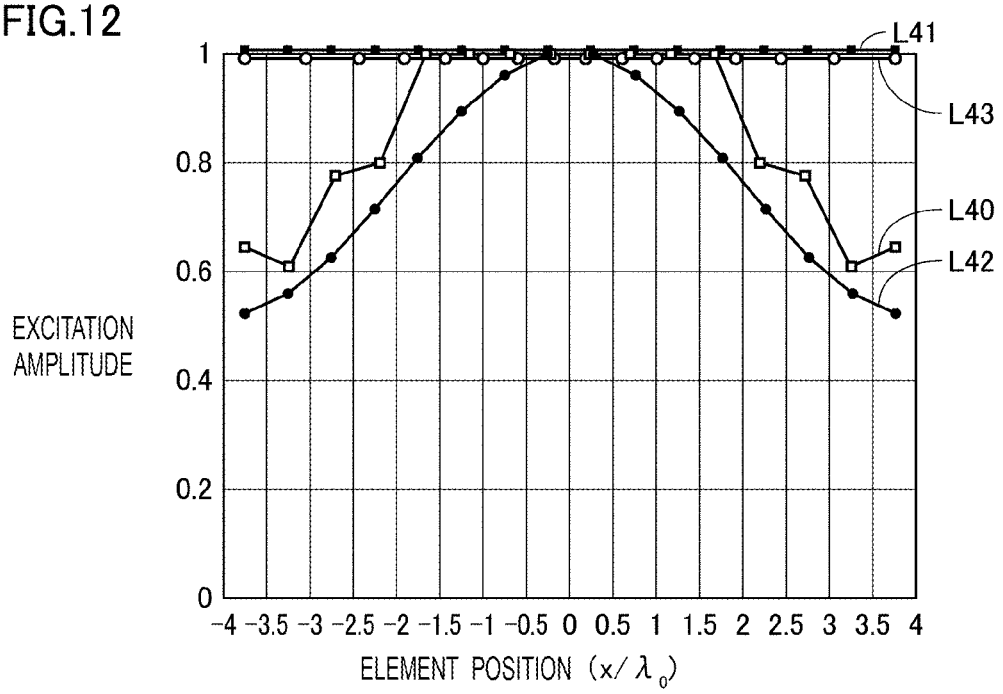
FIG. 12 is provided for explanation of the layout of antenna elements and the excitation amplitude applied to an antenna module according to Embodiment 1 and comparative examples.

FIG. 12 is a graph illustrating the relationship between the element position ($x/\lambda_0$) and the excitation amplitude in Embodiment 1 and in each of the comparative examples. L40, which is a line in FIG. 12, denotes Embodiment 1. L41 to L43, which are the other lines in FIG. 12, denote Comparative Examples 1 to 3, respectively.

Figure 13:
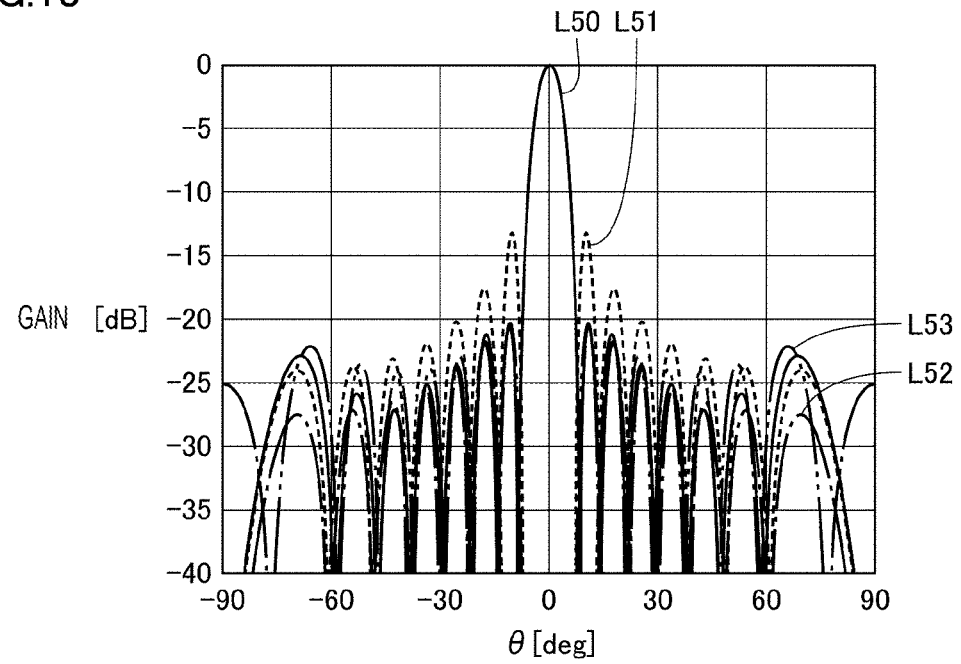
FIG. 13 is provided for comparative explanation of the peak gain for $\theta_0=0°$.
Figures 14, 15:
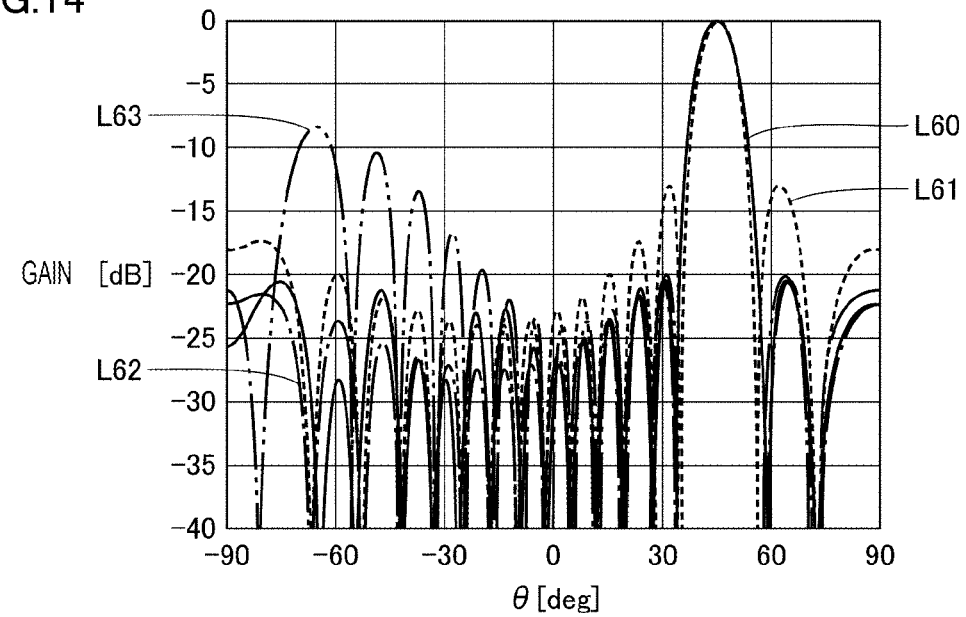
FIG. 14 is provided for comparative explanation of the peak gain for $\theta_0=45°$.
FIG. 15 is provided for explanation of the antenna characteristics of the antenna unit in Embodiment 1 and the antenna characteristics of antenna units in comparative examples.

The main beam was steered in the direction of the azimuth angle $\theta_0$. The peak gain for the azimuth angle $\theta_0=0°$ (no tilt) is represented by the graph in FIG. 13, and the peak gain for the azimuth angle $\theta_0=45°$ is represented by the graph in FIG. 14. Referring to FIGS. 13 and 14, Embodiment 1 is denoted by the solid lines L50 and L60, Comparative Example 1 is denoted by the broken lines L51 and L61, Comparative Example 2 is denoted by dash-dot lines L52 and L62, and Comparative Example 3 is denoted by dash-dot-dot lines L53 and L63.

The results of the simulations are summarized in FIG. 15. In FIG. 15, the total power in Comparative Example 1 is referenced as 0 dB, and the total power in the other fields of the column concerned is indicated by the amount of deviation from the reference point. The side-lobe level in FIG. 15 refers to the ratio of the maximum side-lobe gain to the main-lobe gain.

Referring to FIGS. 12 to 15, the total power in Comparative Example 3, that is, the total power of the density-tapered array excited without application of excitation amplitude tapering is equal to the total power in Comparative Example 1, whereas the total power in Comparative Example 2 and Embodiment 1 involving the application of amplitude tapering is below the reference point. Embodiment 1 involved both the amplitude tapering applied to each end portion (the second antenna group 152) and the density tapering applied in a manner so as to lessen the element spacing in the middle portion of the array (the first antenna group 151). For this reason, the excitation amplitude applied to the second antenna group 152 was made greater than the excitation amplitude applied to the second antenna group 152 of the amplitude-tapered array of Comparative Example 2. As a result, the total power in Embodiment 1 (−1.2 dB) was higher than the total power in Comparative Example 2 (−2.1 dB).

With regard to the side-lobe level for the case in which the main beam was not tilted (the azimuth angle $\theta_0=0°$), all of those except for Comparative Example 1 was comparable to each other (about −20 dBc), and these side-lobe levels were lower than that of Comparative Example 1 (−13.1 dBc). As for the side-lobe level for the case in which the main beam was tilted (the azimuth angle $\theta_0=45°$), the side-love level in each of Comparative Example 2 and Embodiment 1 involving the application of amplitude tapering was about −20 dBc. That is, the side-lobe level as high as the side-lobe level for the azimuth angle $\theta_0=0°$ was achieved. This is not the case with the density-tapered array of Comparative Example 3 (see the line L63 in FIG. 14), in which grating lobes occurred at the points where $\theta<-15°$. The side-lobe level at or around $\theta=-70°$ was −8.5 dBc, which was higher than the side-lobe level in Comparative Example 1 (i.e., the array of equal spacing and equal amplitude). The element spacing on each end portion of the array antenna of Comparative Example 3 was greater than that of the array antennas of other comparative examples and Embodiment 1. This is the reason why the side-lobe level for the case in which the main beam was tilted was higher.

In short, although the array of Comparative Example 1 and the density-tapered array of the Comparative Example 3 achieved high total power, the side-lobe level for the case in which beamforming was involved was high. Comparative Example 2 achieved lower side-lobe level at the cost of insufficient total power. It can thus be concluded that the lower side-lobe level with minimized reduction in total power is achievable in Embodiment 1, in which antenna elements in each end portion (the second antenna group 152) of the array antenna are equally spaced, antenna elements in the middle portion (the first antenna group 151) are unequally spaced, the element spacing in the middle portion is smaller than the element spacing in each end portion, unequal amplitude is applied to some of the antenna elements such that the excitation amplitude applied to the array antenna as a whole is in the form of Taylor distribution.

Embodiment 2

As already mentioned above, the antenna module according to Embodiment 2 includes an antenna unit in the form of a two-dimensional array.

Such a two-dimensional array enables the beam tilt in the azimuth (horizontal) direction (i.e., along the X axis) and the beam tilt in the elevation (vertical) direction (i.e., along the Y axis). It is thus necessary that the tilt in the elevation direction be taken into consideration when the antenna unit is evaluated for the total power and the side-lobe level.

First Example

Figure 16:
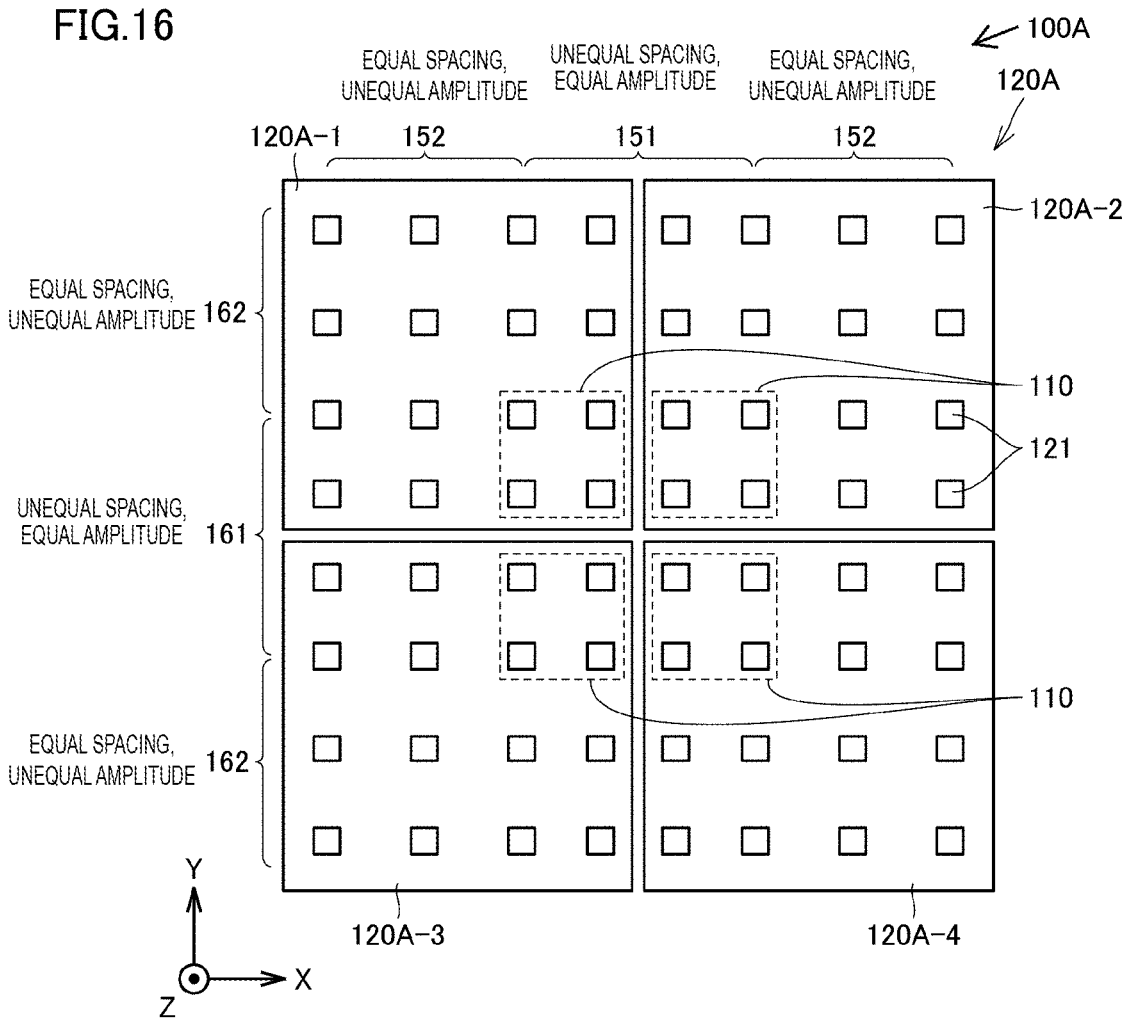
FIG. 16 illustrates a first example of Embodiment 2, in which an antenna unit is in the form of a two-dimensional array.

FIG. 16 illustrates a first example of Embodiment 2, in which an antenna module 100A includes an antenna unit 120A in the form of a two-dimensional array. For easy-to-understand illustration, the following description of Embodiment 2 will be given on the assumption that the two-dimensional array in the first example and a two-dimensional array in a second example, which will be described later, are each an eight-by-eight array. Alternatively, each array may include more antenna elements. For example, each array may be a 16-by-16 array, namely, an array of 256 antenna elements.

The antenna unit 120A in the first example involves unequal element spacing and excitation amplitude tapering in the azimuth direction (i.e., along the X axis) as in Embodiment 1 and also involves unequal element spacing and excitation amplitude tapering in the elevation direction (i.e., along the Y axis).

More specifically, four antenna elements in the middle portion (the first antenna group 151) along the X axis are unequally spaced for application of equal excitation amplitude, and three antenna elements in each end portion (the second antenna group 152) along the X axis are equally spaced for application of excitation amplitude tapering. The element spacing in the second antenna group 152 is greater than the maximum element spacing in the first antenna group 151. The excitation amplitude applied to the second antenna group 152 is smaller than the excitation amplitude applied to the first antenna group 151 and is determined in such a way as to ensure that the excitation amplitude distribution along the X axis is in the form of Taylor distribution as described above with reference to, for example, FIGS. 9A and 9B.

Similarly, four antenna elements in the middle portion (a first antenna group 161) along the Y axis are unequally spaced for application of equal excitation amplitude, and three antenna elements in each end portion (a second antenna group 162) are equally spaced for application of excitation amplitude tapering. The element spacing in the second antenna group 162 is greater than the maximum element spacing in the first antenna group 161. The excitation amplitude applied to the second antenna group 162 is smaller than the excitation amplitude applied to the first antenna group 161 and is determined in such a way as to ensure that the excitation amplitude distribution along the Y axis is in the form of Taylor distribution.

In the first example of Embodiment 2, the antenna unit 120A of the antenna module 100A is configured as a combination of four sub-modules. The sub-modules, respectively, are denoted by 120A-1 to 120A-4. Each sub-module includes sixteen antenna elements 121. The rows of the antenna elements along the X axis are in alignment with each other and the columns of the antenna elements along the Y axis are in alignment with each other. The antenna unit 120A illustrated in FIG. 16 may thus be obtained by combining the structurally identical antenna modules arranged with a rotation of 90° with respect to each other. It is required that radio waves from the individual sub-modules be polarized in the same direction.

In each sub-module, the RFIC 110 is preferably disposed on the (back) side opposite to the side on which radio waves are radiated, and more specifically, the RFIC 110 is preferably situated just behind the antenna elements closely spaced along both the X and Y axes. Referring to FIG. 16, the region concerned is enclosed with the broken line. In the above context of the adequately high total power, it is required that the highest possible excitation amplitude (power supply) be applied to the closely spaced antenna elements in the first antenna groups 151 and 161. The power supplied to each antenna element 121 is partially consumed by the resistive component in the feed line extending from the RFIC 110 to the antenna element 121. For this reason, the RFIC 110 is preferably as close as possible to the antenna elements in the first antenna group to which a higher excitation amplitude is to be applied.

Referring to FIG. 16, regions to which a higher excitation amplitude is to be applied extend around the center of the antenna unit 120A. In each sub-module, the RFIC 110 is adjacent to the center of the antenna unit 120A as illustrated in FIG. 16 such that the RFIC 110 is closer to the antenna elements in the first antenna groups 151 and 161 than to the antenna elements in the second antenna groups 152 and 162. This layout enables the application of the highest possible excitation amplitude to the antenna elements in the first antenna groups 151 and 161, and the adequately high total power may be achieved accordingly.

Referring to FIG. 16, the element spacing pattern and the excitation amplitude pattern formed along the Y axis coincide with the respective patterns formed along the X axis. In the case that the degree of beam tilt along the X axis and the degree of beam tilt along the Y axis do not coincide with each other, different patterns of element spacing and different patterns of excitation amplitude may be formed for different degrees of beam tilt in the respective directions.

Second Example

As described above, the antenna unit in the first example of Embodiment 2 involves unequal element spacing and excitation amplitude tapering in both the azimuth direction and the elevation direction.

As for two-dimensional arrays of antenna units that employ particular forms of beamforming, equal spacing and equal amplitude may be adopted in the azimuth direction or the elevation direction only. For example, this configuration enables a unidirectional beam tilt (in the azimuth direction or the elevation direction only). This configuration is also suited to increasing the total power.

The following describes a second example of Embodiment 2, in which an antenna unit in the form of a two-dimensional array involves unequal element spacing and excitation amplitude tapering in one of the azimuth direction and the elevation direction and equal element spacing and equal excitation amplitude in the other direction.

Figure 17:
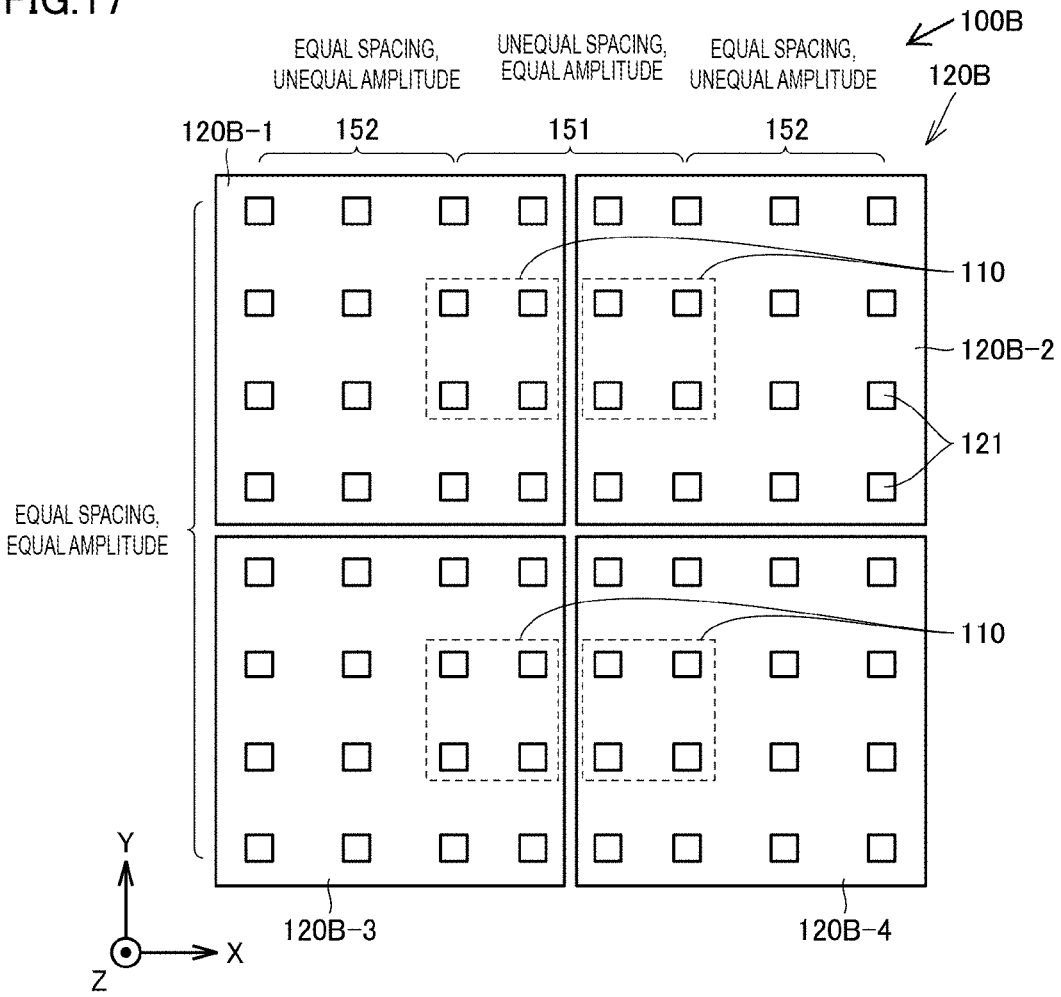
FIG. 17 illustrates a second example of Embodiment 2, in which an antenna unit is in the form of a two-dimensional array.

FIG. 17 illustrates the second example of Embodiment 2, in which an antenna module 100B includes an antenna unit 120B in the form of a two-dimensional array. The antenna unit 120B in the second example involves unequal element spacing and excitation amplitude tapering in the azimuth direction (i.e., along the X axis) and equal element spacing in the elevation direction (i.e., along the Y axis).

As with the antenna unit in the first example, the antenna unit 120B in the second example is configured as a combination of four sub-modules. The sub-modules, respectively, are denoted by 120B-1 to 120B-4. As illustrated in FIG. 17, the sub-module 120B-1 and the submodule 120B-2 are arranged with a rotation of 180° with respect to each other, and the sub-module 120B-3 and the sub-module 120B-4 are arranged with a rotation of 180° with respect to each other. The antenna unit 120B in the second example may thus be configured as a combination of structurally identical antenna modules.

In each sub-module of the antenna unit 120B in the second example, the RFIC 110 is disposed close to the first antenna group 151 to which a higher excitation amplitude is to be applied. The antenna elements in the second example are equally spaced along the Y axis. In each sub-module, the RFIC 110 is adjacent to the center of the first antenna group 151 in the Y-axis direction (the region enclosed by the broken line in FIG. 17). In each sub-module, the RFIC 110 is closer to the antenna elements in the first antenna group 151 than to the antenna elements in the second antenna group 152 accordingly. This layout enables the application of the highest possible excitation amplitude to the antenna elements in the first antenna group 151, and the adequately high power may be achieved accordingly.

As described above, the second example involves equal spacing and equal amplitude in the elevation direction (i.e., along the Y axis). The second example may be modified to better suit the installation state of array antennas; that is, the second example may involve equal spacing and equal amplitude in the azimuth direction (i.e., along the X axis) and unequal spacing and unequal amplitude in the elevation direction.

As described above, the antenna unit in Embodiment 1 is configured as a linear array of identically-shaped and equally-sized antenna elements, and the antenna unit in Embodiment 2 is configured as a two-dimensional array of identically-shaped and equally-sized antenna elements. However, it is not always required that the antenna elements be identically shaped and equally sized. Different-shaped and different-sized antenna elements may be included for the purpose of weakening the coupling between antenna elements and/or adjusting the resonant frequency.

It should be understood that the embodiments disclosed herein are in all aspects illustrative and not restrictive. The scope of the present disclosure is defined by the claims rather than by the description of the embodiments above, and all changes that fall within metes and bounds of the claims, or equivalence of such metes and bounds thereof, are therefore intended to be embraced by the claims.

1 communication system
10 communication device
20A to 20D mobile terminal
100, 100A, 100B antenna module
110 RFIC
111A to 111D, 113A to 113D, 117 switch
112AR to 112DR low-noise amplifier
112AT to 112DT power amplifier
114A to 114D attenuator
115A to 115D phase shifter
116 signal combiner/splitter
118 mixer
119 amplifier circuit
120, 120A, 120B antenna unit
120A-1 to 120A-4, 120B-1 to 120B-4 sub-modules
121 antenna element
130 dielectric substrate
151, 161 first antenna group
152, 162 second antenna group
200 BBIC

The invention claimed is:

1. An antenna module, comprising an array of antenna elements in or on a dielectric substrate, wherein:

the array of the antenna elements extends in a first direction along the dielectric substrate, the array of antenna elements in the first direction includes a first antenna group in a middle portion and second antenna groups in two end portions adjacent to the middle portion, the antenna elements in the first antenna group are unequally spaced, the antenna elements in the second antenna groups are equally spaced, a spacing between adjacent antenna elements in the second antenna groups is greater than a maximum spacing between adjacent antenna elements in the first antenna group, and an amplitude distribution in the antenna module as a whole in the first direction is in a unimodal form, wherein an amplitude of a radio-frequency signal fed to the antenna elements in the second antenna groups is smaller than an amplitude of a radio-frequency signal fed to the antenna elements in the first antenna group.

2. The antenna module according to claim 1, wherein the antenna elements in the first antenna group are arranged in such a manner that a first spacing between adjacent antenna elements closer to either of the two end portions is greater than a second spacing between adjacent antenna elements closer to the middle portion.

3. The antenna module according to claim 1, wherein the spacing between adjacent antenna elements in the second antenna groups is less than 0.6λ, where λ is a wavelength of a radio-frequency signal fed to the antenna elements in the second antenna groups.

4. The antenna module according to claim 1, wherein the amplitude of the radio-frequency signal fed to the antenna elements in the second antenna groups is varied in such a manner that an amplitude applied to an antenna element closer to either of two ends of the antenna module is smaller than an amplitude applied to an antenna element farther from an end of the antenna module.

5. The antenna module according to claim 1, wherein the array of antenna elements has line symmetry in the first direction.

6. The antenna module according to claim 1, wherein the array of the antenna elements extends in both the first direction and a second direction crossing the first direction, and the antenna elements are equally spaced in the second direction.

7. The antenna module according to claim 1, wherein:

the array of the antenna elements extends in both the first direction and a second direction crossing the first direction, the array of antenna elements in the second direction includes a third antenna group in a middle portion and a fourth antenna group in two end portions adjacent to the middle portion, the antenna elements in the third antenna group are unequally spaced, the antenna elements in the fourth antenna group are equally spaced, the spacing between adjacent antenna elements in the fourth antenna group is greater than a maximum spacing between adjacent antenna elements in the third antenna group, and the amplitude distribution in the antenna module as a whole in the second direction is in a unimodal form in which an amplitude of a radio-frequency signal fed to the antenna elements in the fourth antenna group is smaller than an amplitude of a radio-frequency signal fed to the antenna elements in the third antenna group.

8. The antenna module according to claim 6, wherein the array of antenna elements has line symmetry in the second direction.

9. The antenna module according to claim 6, wherein the antenna module is composed of sub-modules, and the sub-modules include an equal number of antenna elements.

10. The antenna module according to claim 9, wherein the sub-modules are structurally identical to each other.

11. The antenna module according to claim 9, wherein the sub-modules are each provided with a feeder circuit configured to feed a radio-frequency signal to the antenna elements included in the corresponding sub-module.

12. The antenna module according to claim 11, wherein the feeder circuit is disposed on a first surface of the dielectric substrate opposite a second surface of the dielectric substrate on which radio waves are radiated from the antenna elements.

13. The antenna module according to claim 11, wherein the feeder circuit is closer to the antenna elements in the first antenna group of the corresponding sub-module than to the antenna elements in the second antenna groups of the corresponding sub-module.

14. The antenna module according to claim 11, wherein the feeder circuit is closer to the antenna elements in the third antenna group of the corresponding sub-module than to the antenna elements in the fourth antenna group of the corresponding sub-module.

15. The antenna module according to claim 1, wherein the first direction is a horizontal direction.

16. The antenna module according to claim 1, wherein the array of the antenna elements is a two-dimensional array.

17. The antenna module according to claim 16, wherein the two-dimensional array comprises identically-shaped and equally-sized antenna elements.

18. The antenna module according to claim 16, wherein the two-dimensional array comprises different-shaped and different-sized antenna elements.

19. The antenna module according to claim 1, wherein the array of the antenna elements is a linear array.

20. A communication device comprising the antenna module according to claim 1.

* * * * *